US007717290B2

(12) United States Patent
Gerding

(10) Patent No.: US 7,717,290 B2
(45) Date of Patent: May 18, 2010

(54) AIR TRANSPORTABLE ISO CONTAINER

(75) Inventor: William J. Gerding, Cadillac, MI (US)

(73) Assignee: AAR Corp., Wood Dale, IL (US)

( * ) Notice: Subject to any disclaimer, the term of this patent is extended or adjusted under 35 U.S.C. 154(b) by 1065 days.

(21) Appl. No.: 10/985,765

(22) Filed: Nov. 10, 2004

(65) Prior Publication Data

US 2005/0103791 A1 May 19, 2005

Related U.S. Application Data

(60) Provisional application No. 60/519,977, filed on Nov. 14, 2003.

(51) Int. Cl.
*B65D 90/14* (2006.01)

(52) U.S. Cl. ..... 220/629; 220/1.5; 254/45

(58) Field of Classification Search ..... 220/629, 220/1.5; 254/45
See application file for complete search history.

(56) References Cited

U.S. PATENT DOCUMENTS

| | | | | |
|---|---|---|---|---|
| 3,966,075 | A | 6/1976 | Schultz | |
| 4,805,794 | A | 2/1989 | Tsuchiya et al. | |
| 4,995,522 | A * | 2/1991 | Barr | 220/1.5 |
| 5,237,784 | A | 8/1993 | Ros | |
| 5,423,518 | A * | 6/1995 | Baxter et al. | 254/419 |
| 5,507,660 | A | 4/1996 | Jalliffier | |
| 5,761,854 | A | 6/1998 | Johnson et al. | |
| 5,878,903 | A | 3/1999 | Ung | |
| 6,622,640 | B2 | 9/2003 | Taylor et al. | |

(Continued)

FOREIGN PATENT DOCUMENTS

| | | |
|---|---|---|
| DE | 4214267 | 11/1993 |

(Continued)

OTHER PUBLICATIONS

Wenzlau Engineering Website, "Gichner Shelter Systems," at http://www.wenzlau.com/products/shelters/iso/specifications.html (Aug. 5, 2003).

(Continued)

*Primary Examiner*—Stephen Castellano
(74) *Attorney, Agent, or Firm*—Barnes & Thornburg LLP

(57) ABSTRACT

A transport device such as an ISO container that is adapted to be transported by air or surface transportation. The transport device includes a base, a plurality of movable ISO corner blocks movably coupled to the base, and a plurality of adjustment mechanisms. Each adjustment mechanism is adapted to couple a respective corner block to the base and to selectively move the corner block with respect to the base between an air transport position, wherein the bottom surface of the corner block does not extend beyond the bottom surface of the base, and a surface transport position wherein the bottom surface of the corner block is located below the bottom surface of the base. The base includes a plurality of roller plates that form the bottom surface of the base and that are adapted to engage rollers of an aircraft cargo handling system. The transport device also includes detent rails that are removably attached to the base. The detent rails includes tabs and detents that are adapted to cooperate with an aircraft cargo handling system to releasably secure the transport device in place within an aircraft.

20 Claims, 15 Drawing Sheets

U.S. PATENT DOCUMENTS

| | | | | |
|---|---|---|---|---|
| 6,655,300 | B1 * | 12/2003 | Clive-Smith et al. | 108/53.5 |
| 7,036,786 | B1 * | 5/2006 | Schura | 248/346.03 |
| 7,059,488 | B2 | 6/2006 | Myers | |
| 2005/0160682 | A1 | 7/2005 | Quadrio | |

FOREIGN PATENT DOCUMENTS

| | | |
|---|---|---|
| DE | 4433061 | 3/1996 |

OTHER PUBLICATIONS

Marshall Expandable Container, AAR Cadillac Manufacturing, May 2001.

Expandable Shelter Systems, Marshall Specialist Vehicles, Mar. 2001.

Marshall Mobile Medical Systems, Marshall SV, Jan. 10, 2002.

Marshall Matrix 2000 Telescopic Expandable Shelter, Marshall Specialist Vehicles, Mar. 2001.

Mobility and Rapid Deployment Capability Presentation, Marshal SV, Jul. 2002.

Video A on CD in Windows Media Format: Marshal Specialist Vehicles—Mobile Emergency Medical Systems, Marshall Specialist Vehicles, Oct. 2000.

Video B on CD in Windows Media Format: Marshal Specialist Vehicles—Power Pack Repair Facility (PPRF), Marshall Specialist Vehicles, Oct. 2000.

* cited by examiner

AIR TRANSPORTABLE ISO CONTAINER

RELATED APPLICATIONS

This application claims the benefit of U.S. Provisional Application No. 60/519,977, filed Nov. 14, 2003.

BACKGROUND

The present disclosure is directed to an internal air transportable transport device such as an ISO container that can directly interface with internal aircraft cargo handling systems and with standard International Organization for Standardization (ISO) container handling systems used in truck, train and ship cargo transportation.

ISO containers have to conform to specific ISO transportation requirements for truck, train and ship modes of transportation. Current ISO shipping containers do not directly interface with traditional aircraft cargo handling systems. Internal aircraft cargo handling systems rely upon the container being shipped having a flat bottom adapted to roll on the internal roller conveyor system of the cargo handling system, and having detent rails along the outside bottom edges of the container being shipped that are adapted to lock the container into position and secure the container in place. The ISO transportation requirements do not require that containers have a flat bottom or detent rails.

Certain requirements within the ISO transportation guidelines dictate against having a flat bottom and dictate the specific size and configuration that a container must maintain. In land or sea transportation an ISO container must include ISO corner blocks that are adapted to lock the container into position and hold it securely. The ISO corner blocks are located at each of the eight corners of the container. The four bottom ISO corner blocks are required to maintain an average distance of approximately one-half inch (12.5 millimeters) below any other part of the container base. This is in direct opposition to the requirements of an aircraft cargo handling system. Therefore, in order to ship an ISO container within an aircraft it has been necessary to place the ISO container on an intermediate structure such as an airlift pallet for container roll-in/out platform as disclosed in U.S. Pat. No. 6,622,640 of AAR Corp.

SUMMARY

A transport device such as an ISO container that is adapted to be transported by air transportation or surface transportation. The transport device includes a base having a plurality of roller plates that form a bottom surface. The roller plates are adapted to engage the rollers of an aircraft cargo handling system. The transport device also includes first and second side rails each of which has a plurality of tabs and detents that are adapted to cooperate with an aircraft cargo handling system to releasably secure the transport device in place within an aircraft. The first and second detent rails are adapted to be removably attached respectively to a first side rail and an opposing second side rail of the base.

One or more movable ISO corner blocks are movably coupled to the base. A respective adjustment mechanism movably couples each corner block to the base. Each adjustment mechanism is adapted to selectively position a corner block with respect to the base and to selectively move the corner block between a surface transport position, wherein a bottom surface of the corner block is located below the bottom surface of the base, and an air transport position wherein the bottom surface of the corner block is located generally coplanar with or above the bottom surface of the base. The adjustment mechanisms may also selectively position the corner blocks in an extended position located beyond the transport position to place the base in a level position when the base is supported by the corner blocks. Each adjustment mechanism includes a rotatable threaded shaft coupled to a corner block and an actuator for rotating the shaft about its central axis. A leg may be attached to a corner block and be threadably attached to the shaft such that rotation of the shaft provides movement of the leg and the corner block along a translational axis. A connector member may be coupled to the corner block that includes one or more locking pins that are selectively movable between a retracted position and an extended position to selectively lock the corner block in the surface transport position.

BRIEF DESCRIPTION OF THE DRAWING FIGURES

DETAILED DESCRIPTION

Figure 9:
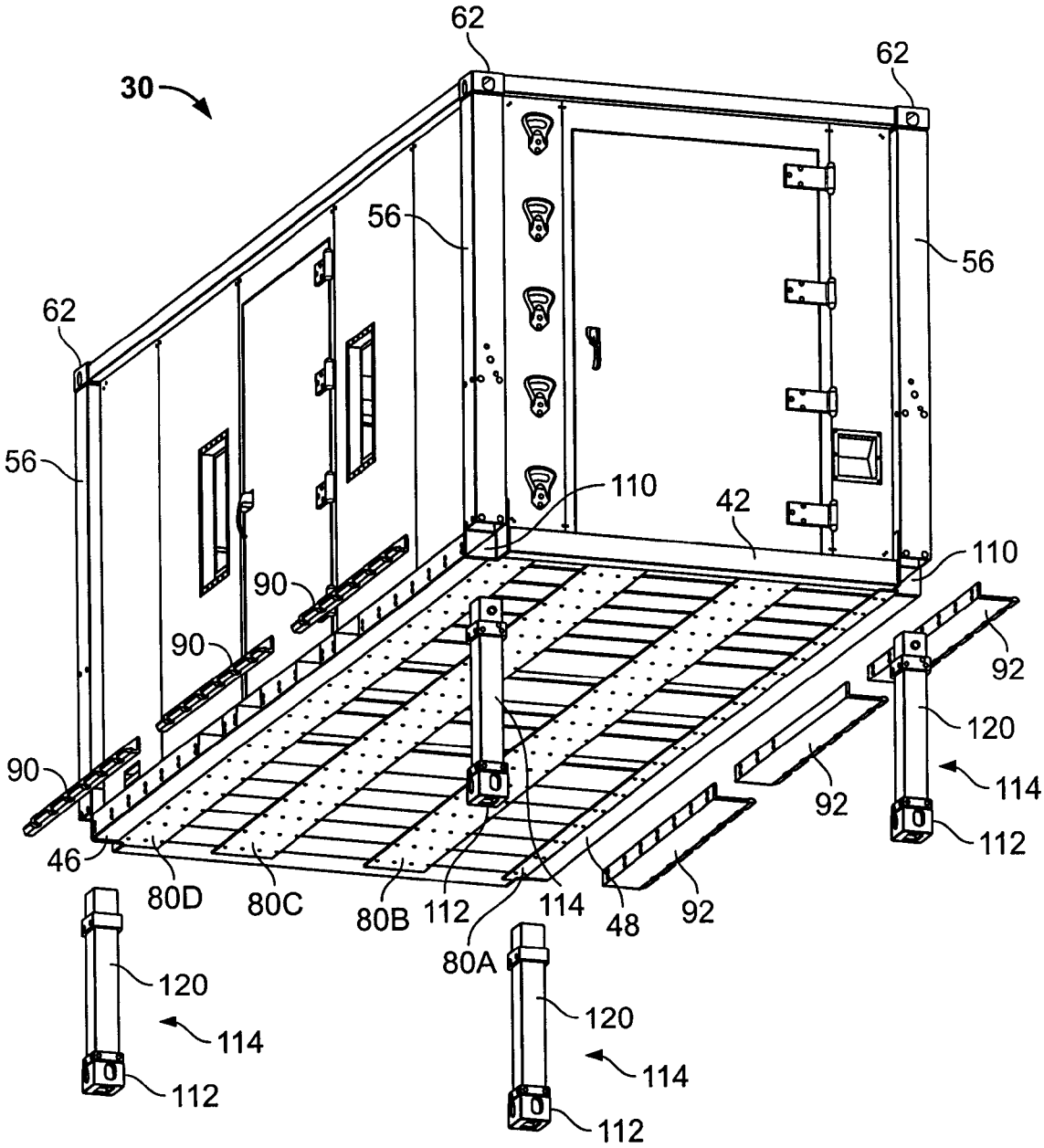
FIG. 9 is a partial exploded perspective view of the ISO container.
Figure 10:
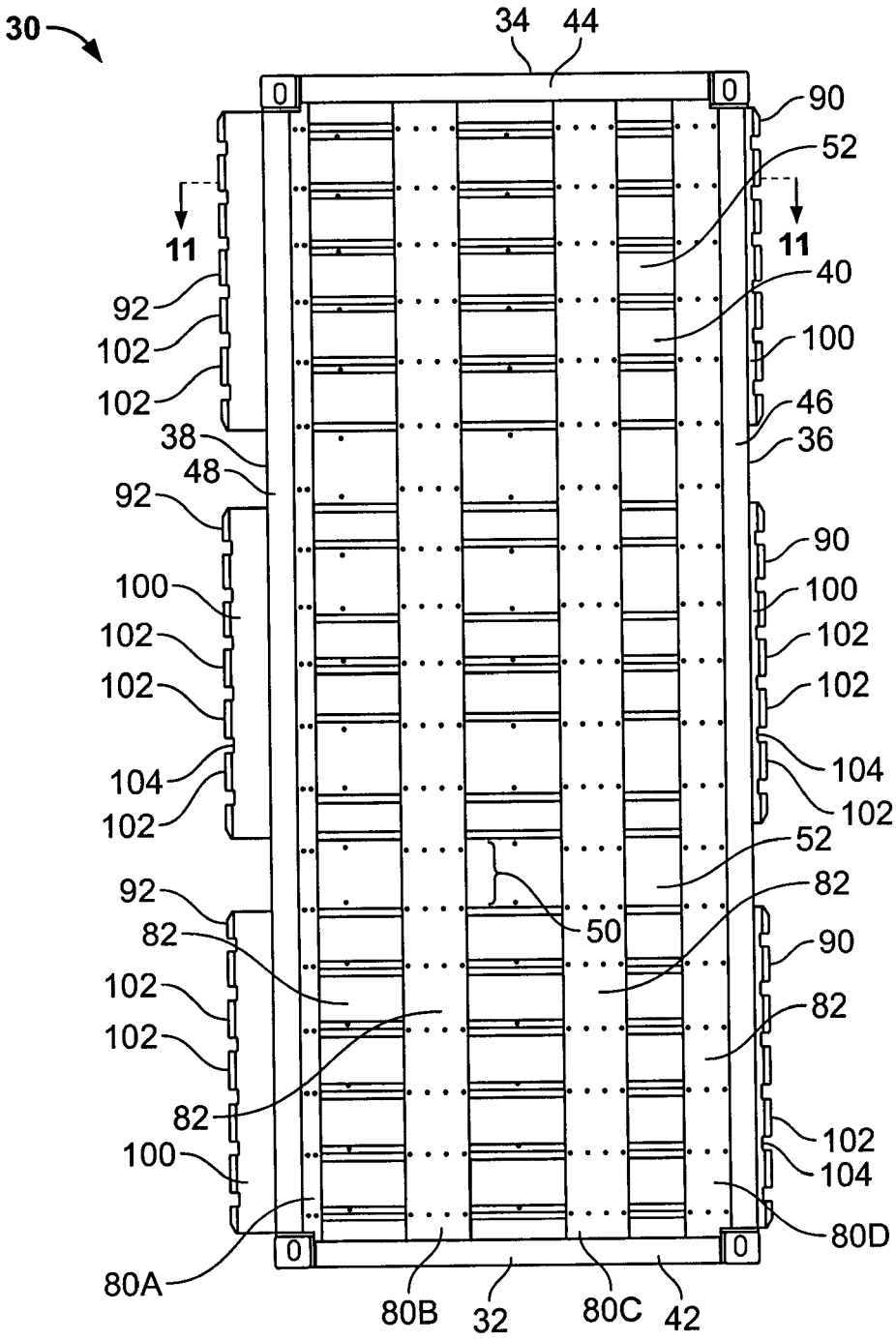
FIG. 10 is a bottom view of the ISO container.

A transport device that is internally transportable within an aircraft, such as an ISO container 30, is shown in FIGS. 1-11. The internal air transportable ISO container 30 extends between a first longitudinal end 32 and a second longitudinal end 34, and between a first transverse end 36 and a second transverse end 38. The term "container" as used herein also encompasses the term "shelter." The ISO container 30 includes a base 40 as shown in FIG. 10. The base 40 includes a first end rail 42 at the first longitudinal end 32 and a spaced apart and generally parallel second end rail 44 located at the second longitudinal end 34. The base 40 also includes a first side rail 46 at the first transverse end 36 and a second side rail 48 at the second transverse end 38. Each of the side rails is elongate and generally linear. A plurality of support members 50 extend transversely between the side rails 46 and 48. The support members 50 are spaced apart from one another and are generally parallel to one another. A plurality of floor panels 52 are located on top of, and are supported by, the support members 50. The floor panels 52 extend between the end rails 42 and 44 and side rails 46 and 48 forming a generally nonperforate surface.

The container 30 includes a plurality of corner posts 56, one corner post 56 being located at each of the four corners of the container 30. Each corner post 56 extends between a bottom end 58 and a top end 60. Each corner post 56 is a generally linear rectangular tube including a plurality of planar side walls 57A-D that form a hollow chamber. The side wall 57A includes an aperture 61. An ISO corner block 62 that conforms to ISO standards is attached to the top end 60 of each corner post 56. Each corner block 62 includes a top wall including an aperture, a first side wall including an aperture, and a second side wall including an aperture. Upper side rails 64 and upper end rails 66 extend between the corner blocks 62 and the top ends 60 of the corner posts 56. One or more roof panels 68 extend between the upper side rails 64 and upper end rails 66 to form a substantially nonperforate roof. One or more side panels 70 extend between the corner posts 56 and upper and lower rails to form side walls. The side panels 70 may include doors, windows and other types of openings, and tie down members. The lower side rails 46 and 48 each include at least one pair of spaced apart openings 72. The openings 72 are adapted to receive the forks of a forklift truck.

Figure 11:
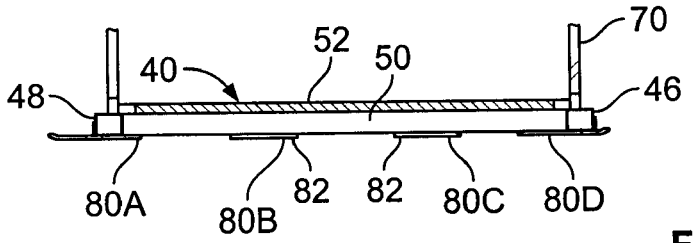
FIG. 11 is a partial cross sectional view taken along line 11-11 of FIG. 10.
Figure 12:
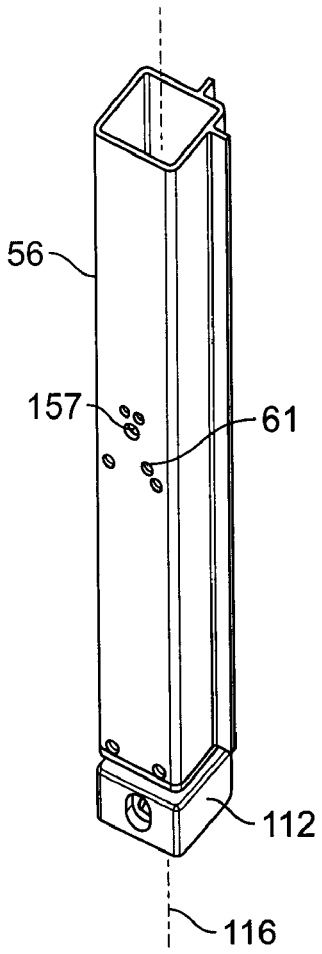
FIG. 12 is a perspective view of a corner post and jack with the ISO corner block shown in the ISO surface transport position.
Figure 13:
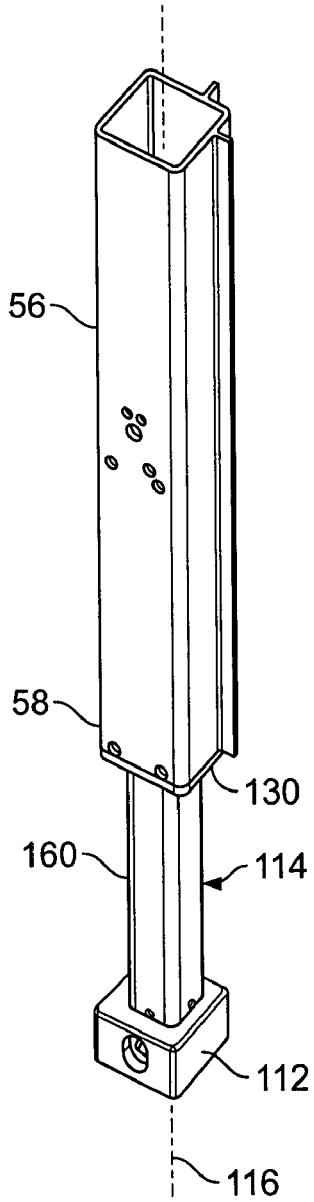
FIG. 13 is a perspective view of a corner post and jack with the leveling leg shown in an extended leveling position.
Figure 14:
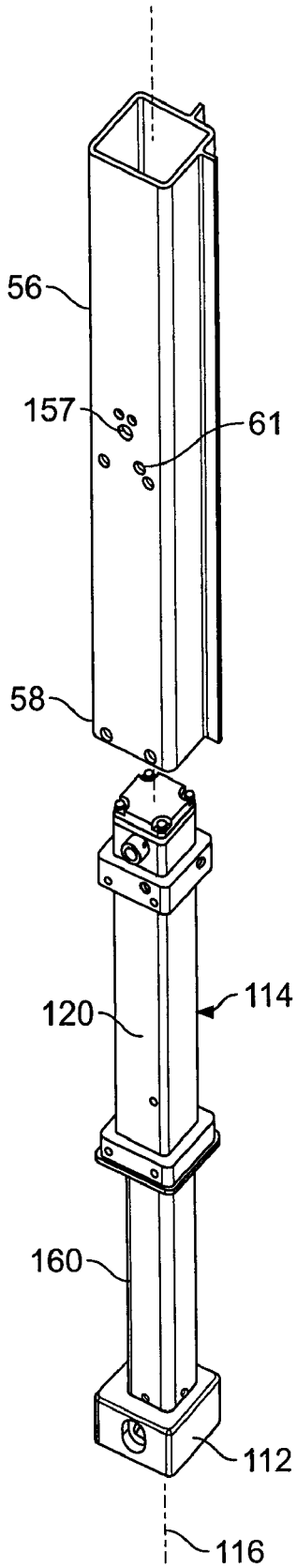
FIG. 14 is a perspective view showing the jack removed from a corner post.
Figure 15:
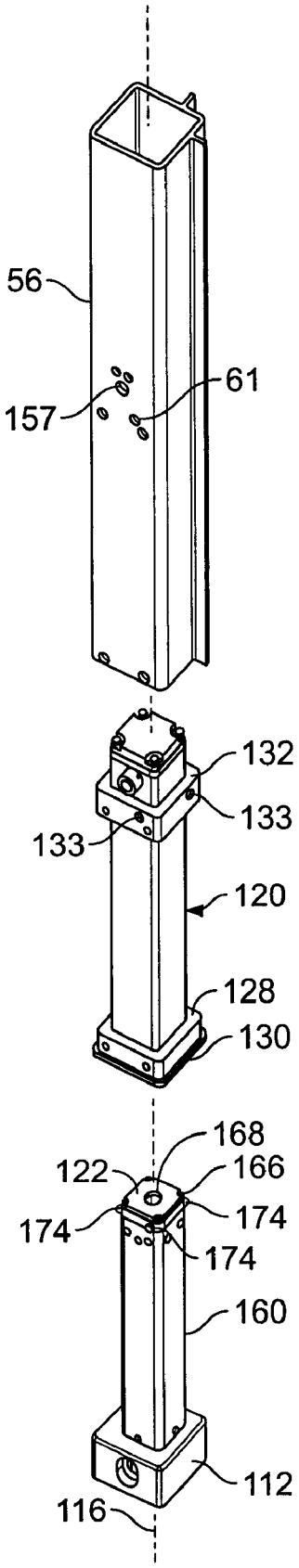
FIG. 15 is a perspective view showing the leveling leg removed from the housing of the jack.
Figure 16:
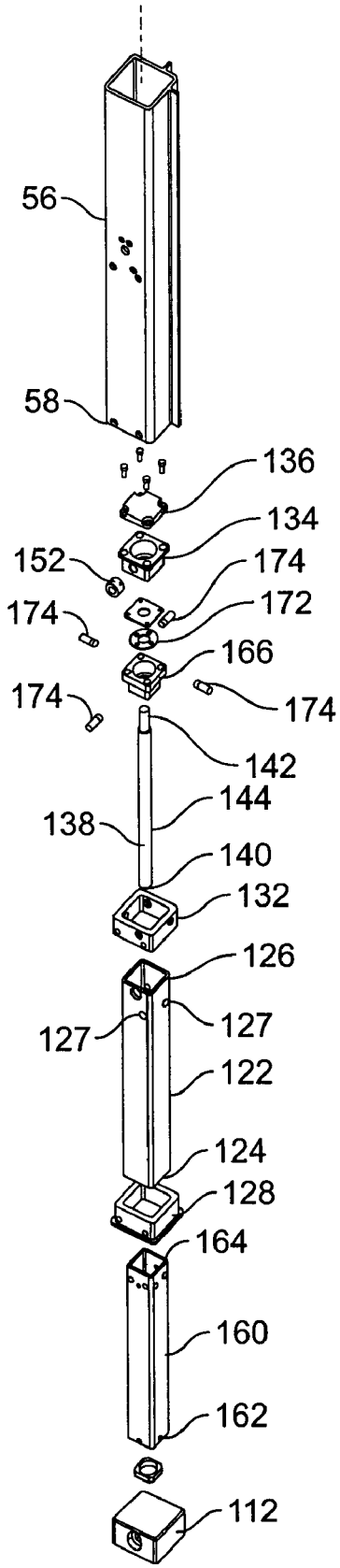
FIG. 16 is an exploded view of the jack.

As shown in FIGS. 10 and 11, the base 40 of the container 30 includes a plurality of roller plates 80A-D attached to the bottom of the support members 50. The roller plates 80A-D are spaced apart and generally parallel to one another and extend generally linearly between the first longitudinal end 32 and second longitudinal end 34 of the container 30. Each roller plate 80A-D is generally plate-like including a planar upper surface attached to the bottoms of the support members 50, and a generally planar bottom surface 82. The roller plate 80A is located adjacent to and extends along the second side rail 48 and the roller plate 80D is located adjacent to and extends along the first side rail 46. Each roller plate 80A-D is adapted to engage a respective set of rollers of an aircraft cargo handling system to thereby provide rolling support for the container 30 on the rollers. The roller plate 80A is approximately 3.5 inches wide, the roller plate 80B is approximately 12.8 inches wide, the roller plate 80C is approximately 12.8 inches wide, and the roller plate 80D is approximately 9.0 inches wide. The roller plate 80B is spaced approximately 13.4 inches from the roller plate 80A. The roller plate 80C is spaced approximately 20.0 inches from the roller plate 80B. The roller plate 80D is spaced approximately 13.5 inches from the roller plate 80C.

The bottom surfaces 82 of the roller plates 80A-D are substantially coplanar such that the bottom surfaces 82 of the roller plates 80A-D thereby provide a flat bottom surface that is required for air transport of the container 30. Utilizing a plurality of roller plates 80A-D which are sized and spaced to work with a variety of different aircraft cargo handling systems reduces the cost and weight that would otherwise be involved if the entire floor area of the container 30 were covered completely with a roller plate.

The container 30 also includes one or more narrow detent rails 90 and one or more wide detent rails 92. The narrow detent rails 90 are adapted to be removably and replaceably attached to the outer vertical wall of the first side rail 46. The wide detent rails 92 are adapted to be removably and replaceably attached to the outer vertical wall of the second side rail 48. The detent rails 90 and 92 are generally L-shaped in cross section having a generally vertical upstanding leg 94 including a plurality of apertures 96 which are adapted to align with apertures 98 in the outer vertical walls of the side rails 46 and 48. The upstanding legs 94 of the detent rails 90 and 92 are adapted to be removably attached to the side rails 46 and 48 by fasteners such as threaded bolts or screws.

The detent rails 90 and 92 also include a generally horizontal leg 100 that extends outwardly from the bottom of the upstanding leg 94 at a right angle thereto. The outer edge of the horizontal leg 100 includes a plurality of tabs 102 which are spaced apart from one another along the length of the detent rails and which project outwardly and horizontally. A detent 104 is located between each adjacent pair of tabs 102. The tabs 102 and detents 104 of the detent rails 90 and 92 are adapted to operate in cooperation with the cargo handling system of a cargo transport aircraft to releasably secure the container 30 in place within the aircraft for transport. A plurality of detent rails 90 and 92 may be located along the length of each of the side rails 46 and 48 and spaced apart from one another to provide access to the openings 72 in the side rails. The tabs 102 of wide detent rail 92 are spaced farther from the upstanding leg 94 than are the tabs 102 of the narrow detent rail 90. The detent rails 90 and 92 are removably attached to the side rails 46 and 48 of the container 30 to place the container 30 in an air transport position or mode wherein the container 30 can be secured within an aircraft by a cargo handling system. The detent rails 90 and 92 may be removed from the container 30 to place the container in an ISO surface transport position or mode wherein the container 30 meets the ISO requirements for an ISO container to be shipped by truck, rail or ship.

As shown in FIG. 9, each lower corner of the container 30 includes a pocket 110 formed between the ends of a side rail and an end rail, and that is located below the bottom end 58 of a corner post 56. Each pocket 110 is adapted to receive a lower ISO corner block 112 that complies with ISO requirements and that includes a plurality of apertures. Each corner block 112 includes a bottom surface 113. Each corner block 112 includes a bottom wall including the bottom surface 113 and an aperture in the bottom wall surface 113, a first side wall including an aperture, and a second side wall including an aperture. Each corner block 112 is movably attached to a respective corner post 56. An adjustment mechanism including an actuator such as a jack 114 is attached to each corner post 56. Each jack 114 movably attaches an ISO corner block 112 to a respective corner post 56. The jack 114 is adapted to selectively move the corner block 112 along a generally linear translational axis 116 which is generally coaxial with the central axis of the corner post 56.

The jack 114 includes a housing 120. The housing 120 includes an outer generally rectangular tubular member 122 having a first end 124 and a second end 126. Each of the four side walls of the tubular member 122 includes an aperture 127. The housing 120 is located within the internal chamber of a corner post 56. A first spacer collar 128 is attached to the bottom end 124 of the tubular member 122 and extends around the circumference of the tube 122. The spacer collar 128 fills the annular chamber formed between the tubular member 122 and the corner post 156. The bottom end of the first spacer collar 128 includes an outwardly extending lip 130 that is adapted to engage the perimeter of the bottom edge of the corner post 56. A plurality of fasteners removably attach the first spacer collar 128 and housing 120 to the corner post 56. A second spacer collar 132 is attached to the tubular member 122 adjacent the upper second end 126 of the tubular member 122. The second spacer collar 132 also fills the annular chamber formed between the tubular member 122 and the corner post 56. Each of the four side walls of the spacer collar 132 includes a bore 133. A plurality of fasteners removably attach the second spacer collar 132 and housing 120 to the corner post 56. A cap member 134 is attached to the second end 126 of the tubular member 122, and a cover 136 is attached to the cap member 134.

The jack 114 includes an elongate rotatable shaft 138 having a first end 140 and a second end 142. The shaft 138 includes a threaded portion 144 that extends from the first end 140 toward the second end 142. The second end 142 of the shaft 138 is attached to a thrust collar 146. The thrust collar 146 rotationally engages a bearing cone 148 located between the thrust collar 146 and the cover 136. A bevel gear 150 is attached to the second end 142 of the shaft 138 and to the thrust collar 146. The shaft 138, thrust collar 146 and bevel gear 150, are selectively conjointly rotatable about the central axis of the shaft 138 which is coaxial with the translational axis 116. An actuator includes a drive member 152 that is rotatably attached to the housing 120. The drive member 120 includes a pinion gear 154 in mesh engagement with the bevel gear 150. The drive member 152 includes a socket 156 in communication with an aperture 157 in the corner post 56. The socket 156 is adapted to receive a crank member, such as a one-half inch drive ratchet. The drive member 152 is adapted to be selectively rotated about a central axis 158 that is transverse to the axis 116. Rotation of the drive member 152 about the axis 158 provides rotation of the shaft 138 about the axis 116.

The jack 114 includes an elongate leg 160 having a first end 162 and a second end 164. The leg 160 may be a generally rectangular inner tubular member that is adapted to fit closely within the outer tubular member 122 of the housing 120. The first end 162 of the leg 160 is attached to a corner block 112. The second end 164 of the leg 160 is attached to a connector member 166. The connector member 166 includes a central generally circular threaded bore 168 that is threadably attached to the threaded portion 144 of the shaft 138. The connector member 166 includes an outer peripheral side wall 170 that fits closely within the tubular member 122 of the housing 120. The connector member 166 includes an annular ring 172 that extends around the bore 168 and that is rotatably connected to the connector member 166 for selective rotation about the translational axis 116. The connector member 166 also includes a plurality of locking pins 174, each located within a respective bore. Each locking pin 174 includes a first end 176 pivotally attached to the ring 172 and a second end 178 that is adapted to selectively extend into and through an aperture 127 in the tubular member 122 of the housing 120. Each locking pin 174 is linearly slidable along its central axis between a retracted position wherein the second end 178 of the locking pin 174 is located within the connector member 166 and an extended position wherein the second end 178 of the locking pin 174 extends into and through the aperture 127 in the tubular member 122 and into a bore 133 of the spacer collar 132. The annular ring 172 and locking pins 174 are resiliently biased by a biasing member 180, such one or more springs, toward their extended positions while being selectively retractable to their retracted positions.

Figure 17:
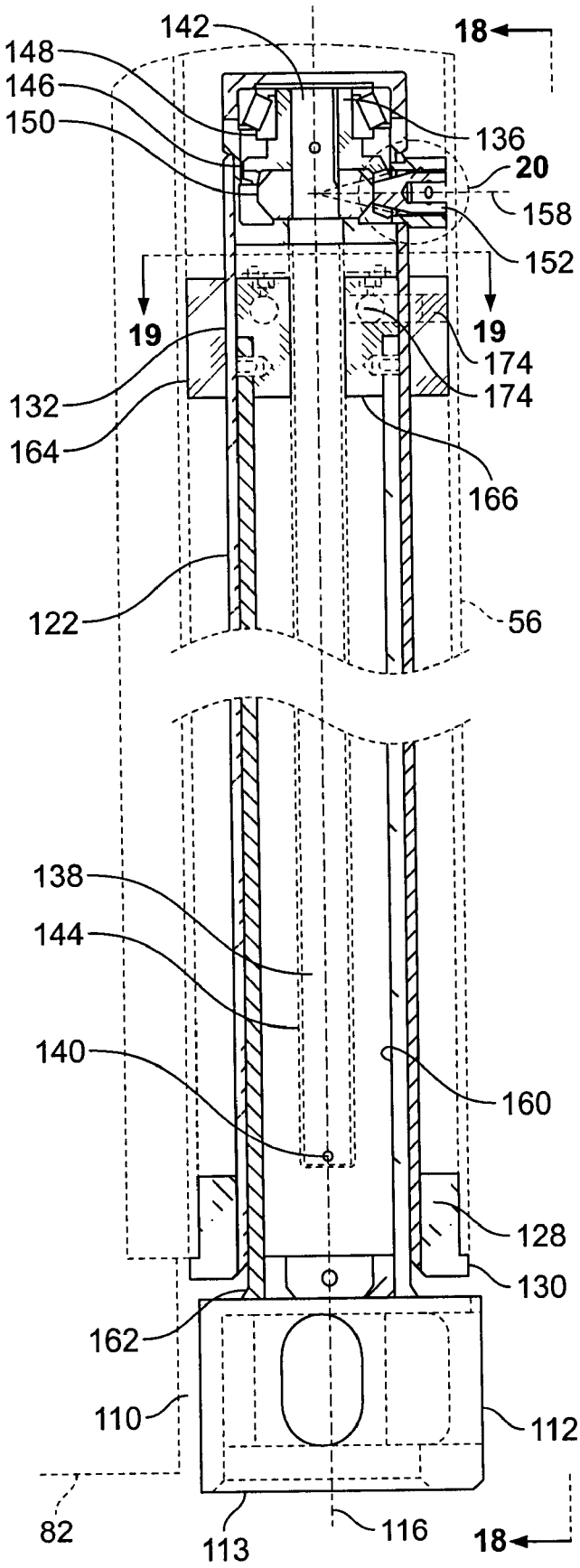
FIG. 17 is a cross sectional view of the jack with the ISO corner block shown in the ISO surface transport position.
Figure 18:
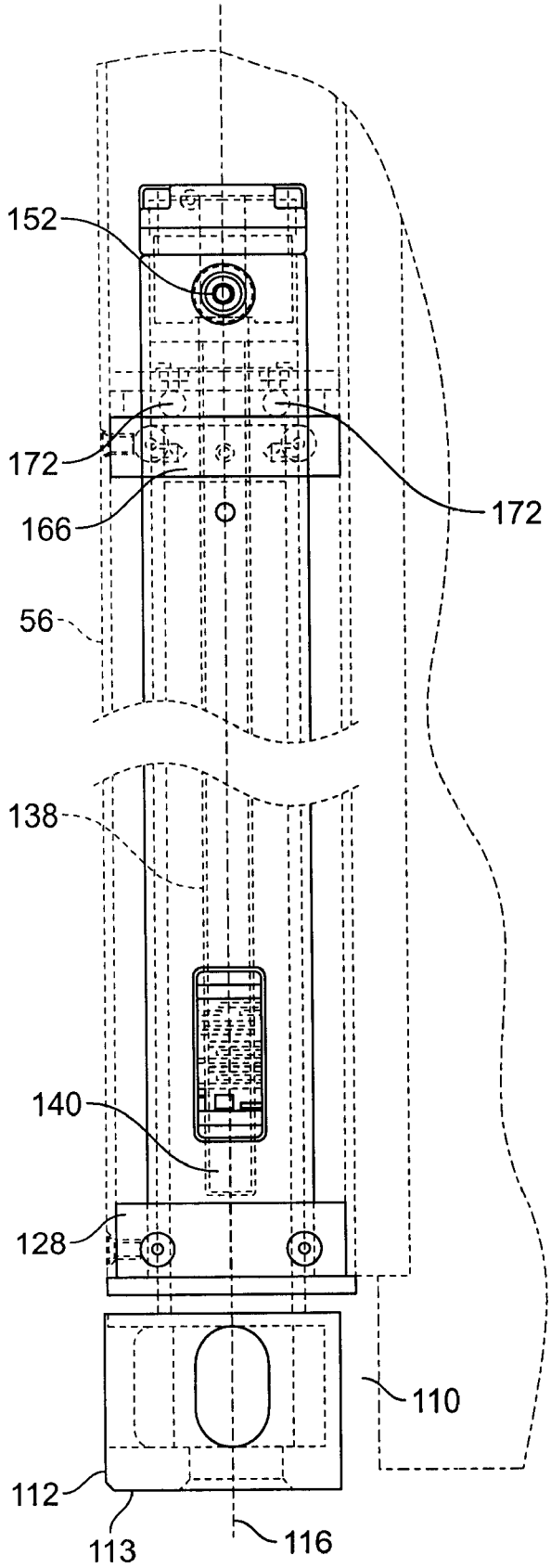
FIG. 18 is a partial side elevational view of the jack taken along line 18-18 of FIG. 17.
Figure 19:
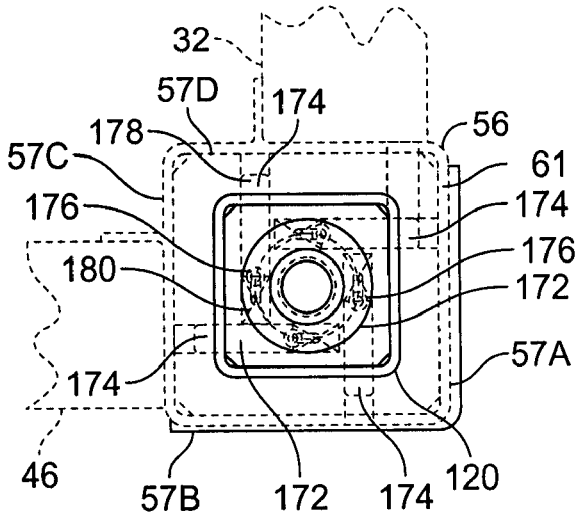
FIG. 19 is a cross sectional view taken along line 19-19 of FIG. 17.
Figure 20:
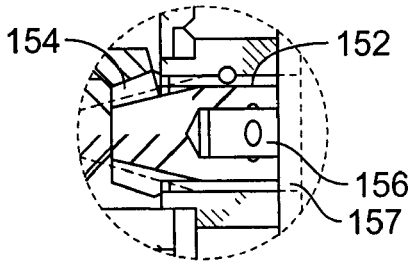
FIG. 20 is an enlarged cross sectional view of the drive member of the jack.
Figure 21:
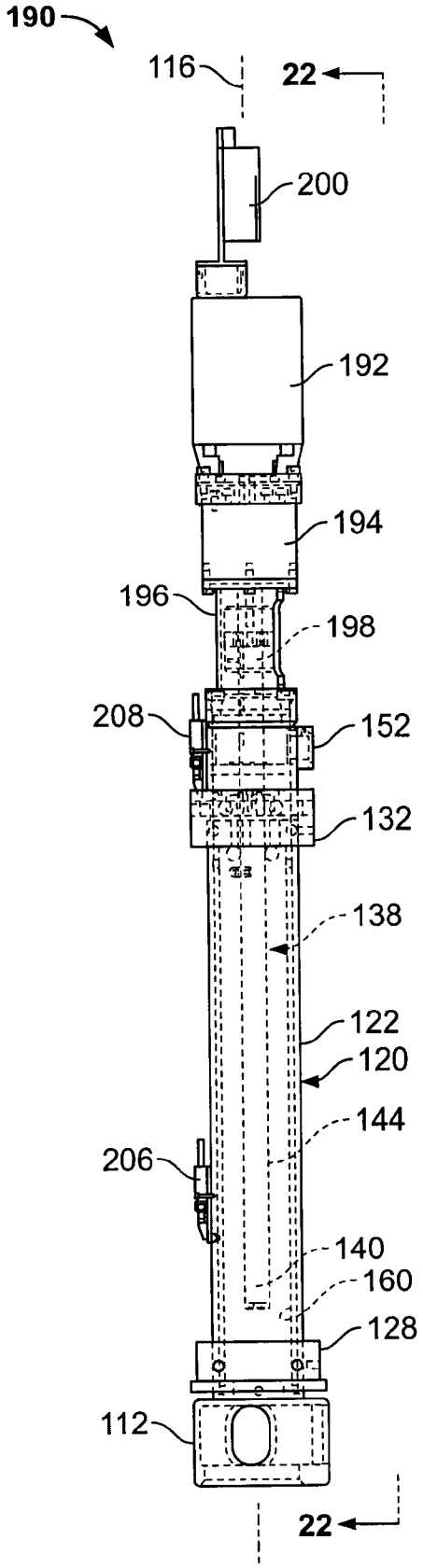
FIG. 21 is a side elevational view of the jack with a motor drive.
Figure 22:
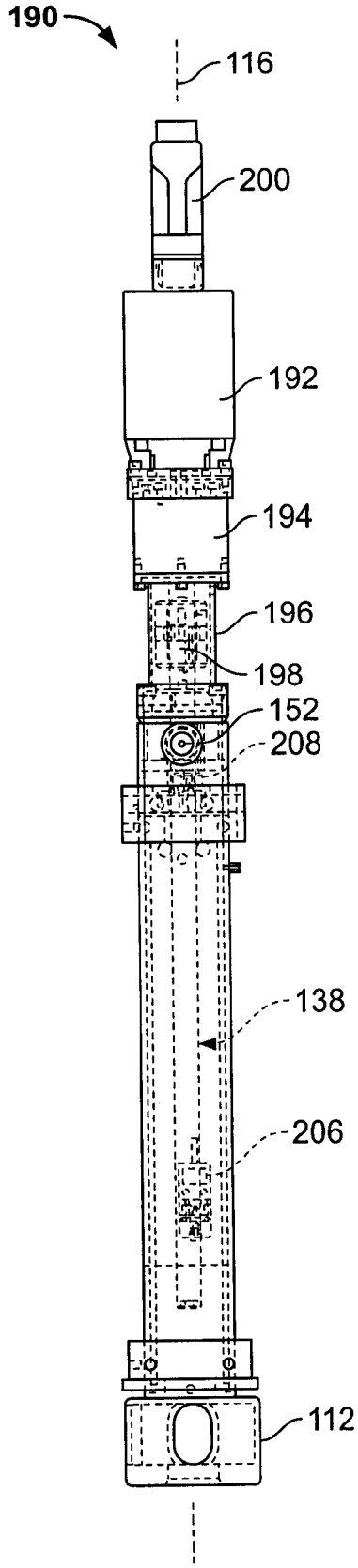
FIG. 22 is a side elevational view taken along line 22-22 of FIG. 21.
Figure 23:
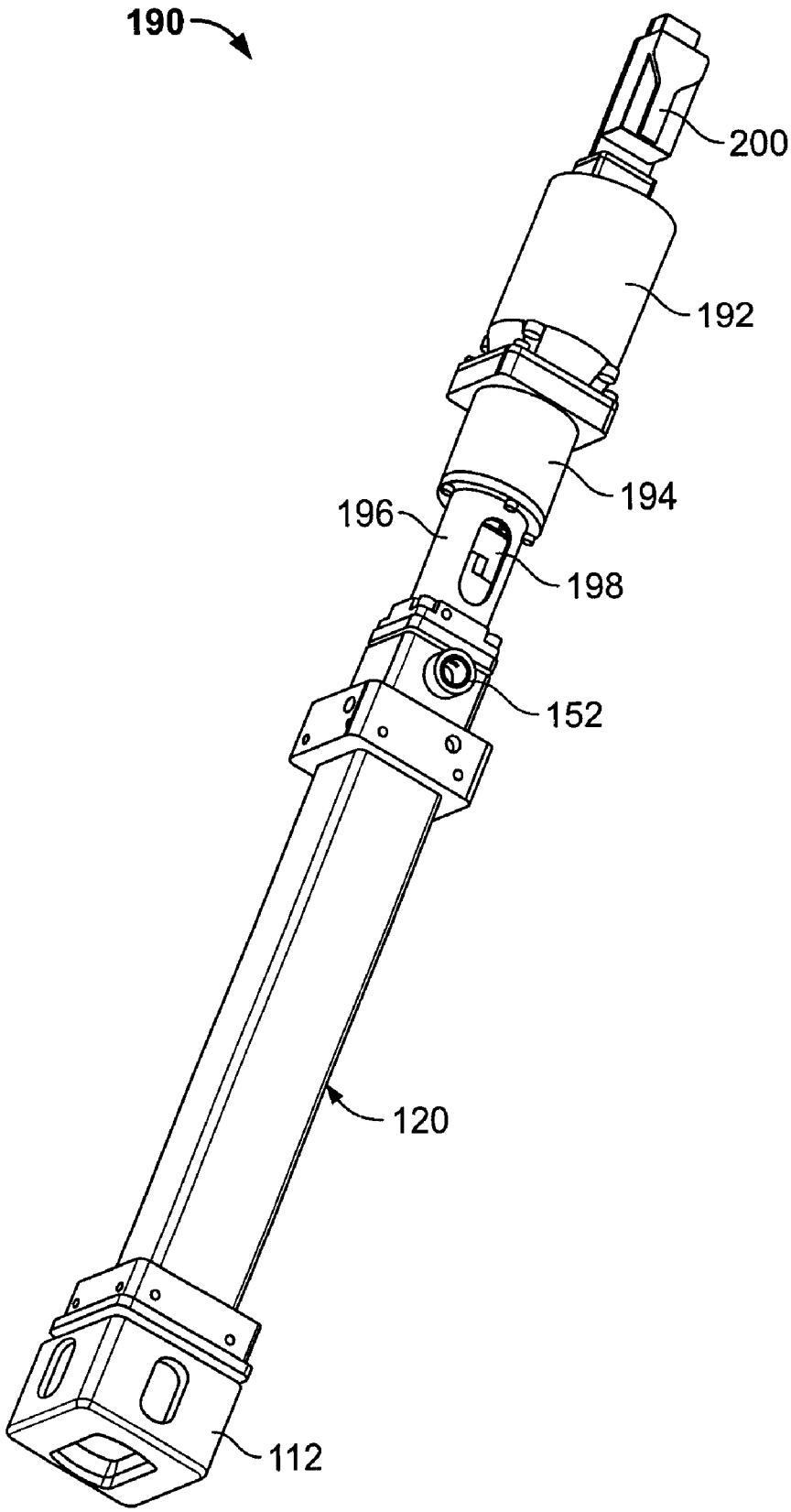
FIG. 23 is a first perspective view of the jack with a motor drive.
Figure 24:
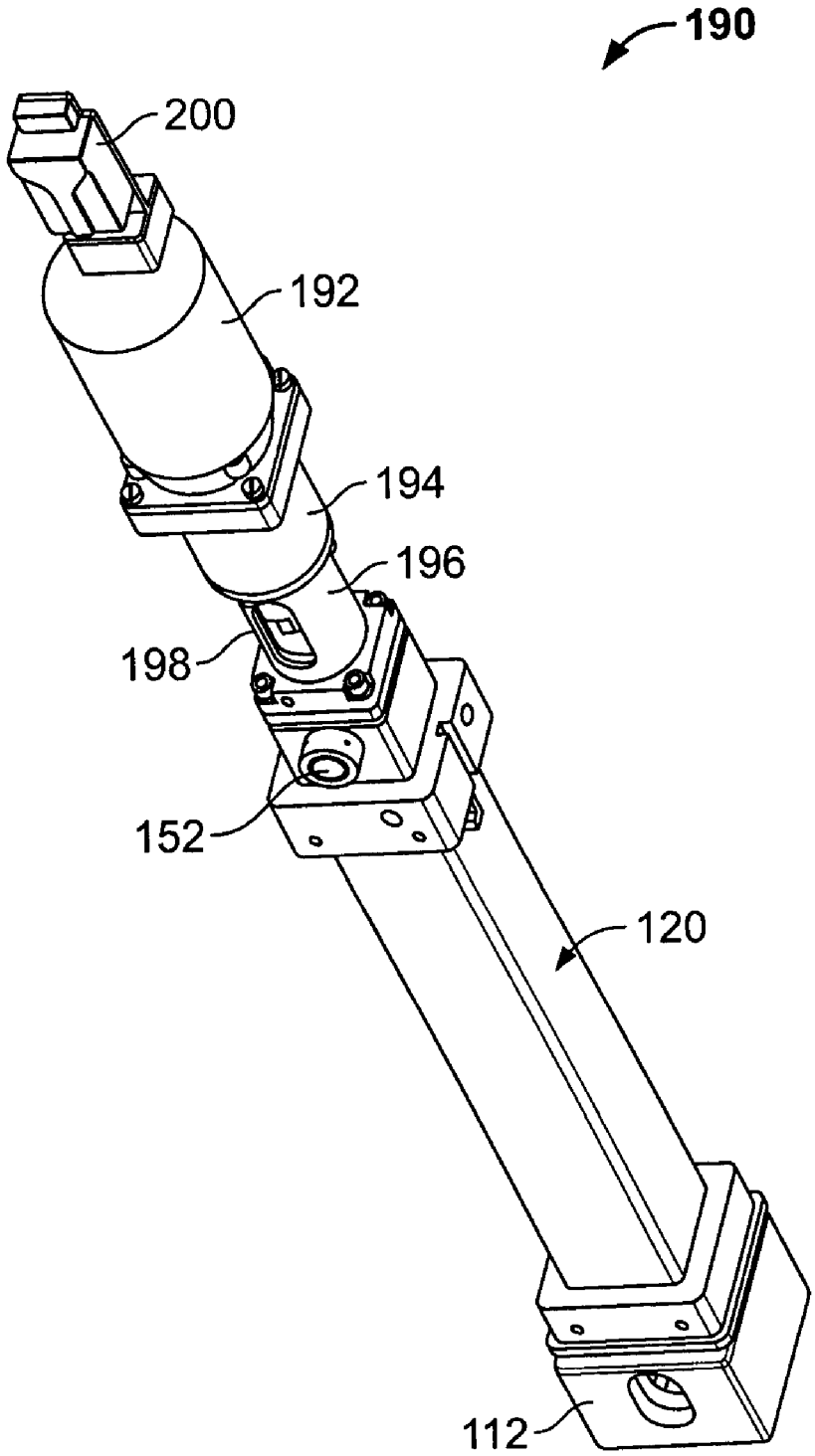
FIG. 24 is a second perspective view of the jack with a motor drive.

When the ISO corner block 112 is located in the ISO surface transport position as shown in FIGS. 17 and 18, such that the bottom surface 113 of the ISO corner block 112 is located approximately one-half inch below the bottom surface 82 of the roller plates 80A-D, the connector member 166 and locking pins 174 are aligned with the apertures 127 in the tubular member 122 of the housing 120. The resiliently biased locking pins 174 automatically extend through the apertures 127 in the tubular member 122 of the housing 120 to thereby lock the connector member 166, leg 160 and corner block 112 in a stationary position along the translational axis 116. When it is desired to move the corner block 112 along the translational axis 116, the locking pins 174 are retracted to their retracted positions such that the connector member 166, leg 160 and corner block 112 are selectively movable along the axis 116.

When the corner block 112 is in the ISO surface transport position, the locking pins 174 can be moved to their retracted position by inserting an object or tool, such as a screwdriver, through the aperture 61 in the corner post 56 to engage the second end 178 of the associated locking pin 174 and manually move the locking pin 174 to its retracted position. The retraction of one locking pin 174 rotates the ring 172 and simultaneously retracts all of the locking pins 174 to their retracted positions. While the locking pins 174 are manually held in their retracted positions, the leg 160 is moved along the axis 116 to move the locking pins 174 out of alignment with the apertures 127 in the tube 122. The retraction tool may then be removed from the aperture 61 in the corner post 56 whereupon the second ends 178 of the locking pins 174 will engage the inner surface of the tubular member 122 while allowing movement of the leg 160 and corner block 112 along the axis 116.

Figure 1:
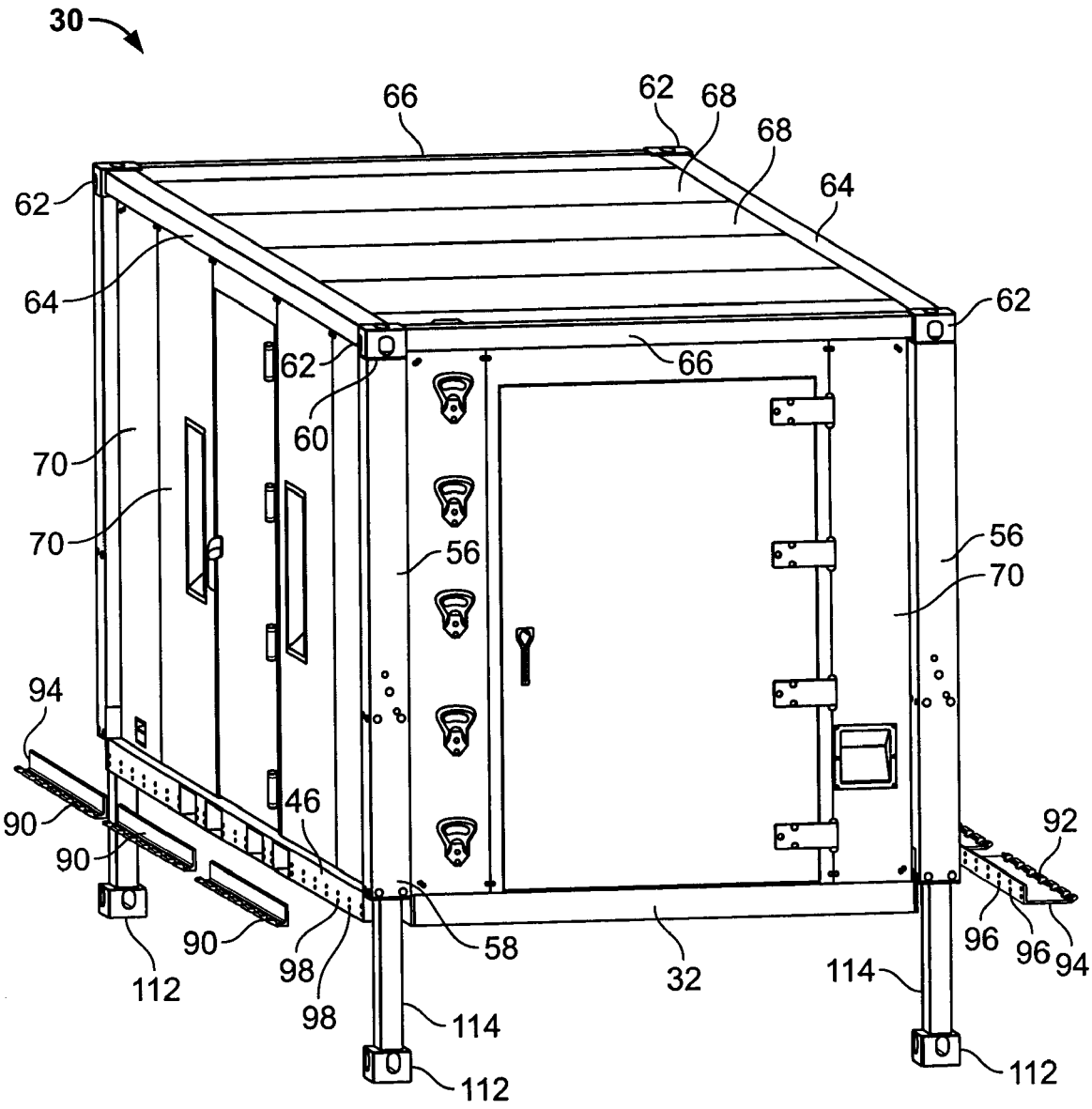
FIG. 1 is perspective view of the air transportable ISO container shown with the lower ISO corner blocks extended and detent rails detached.
Figure 2:
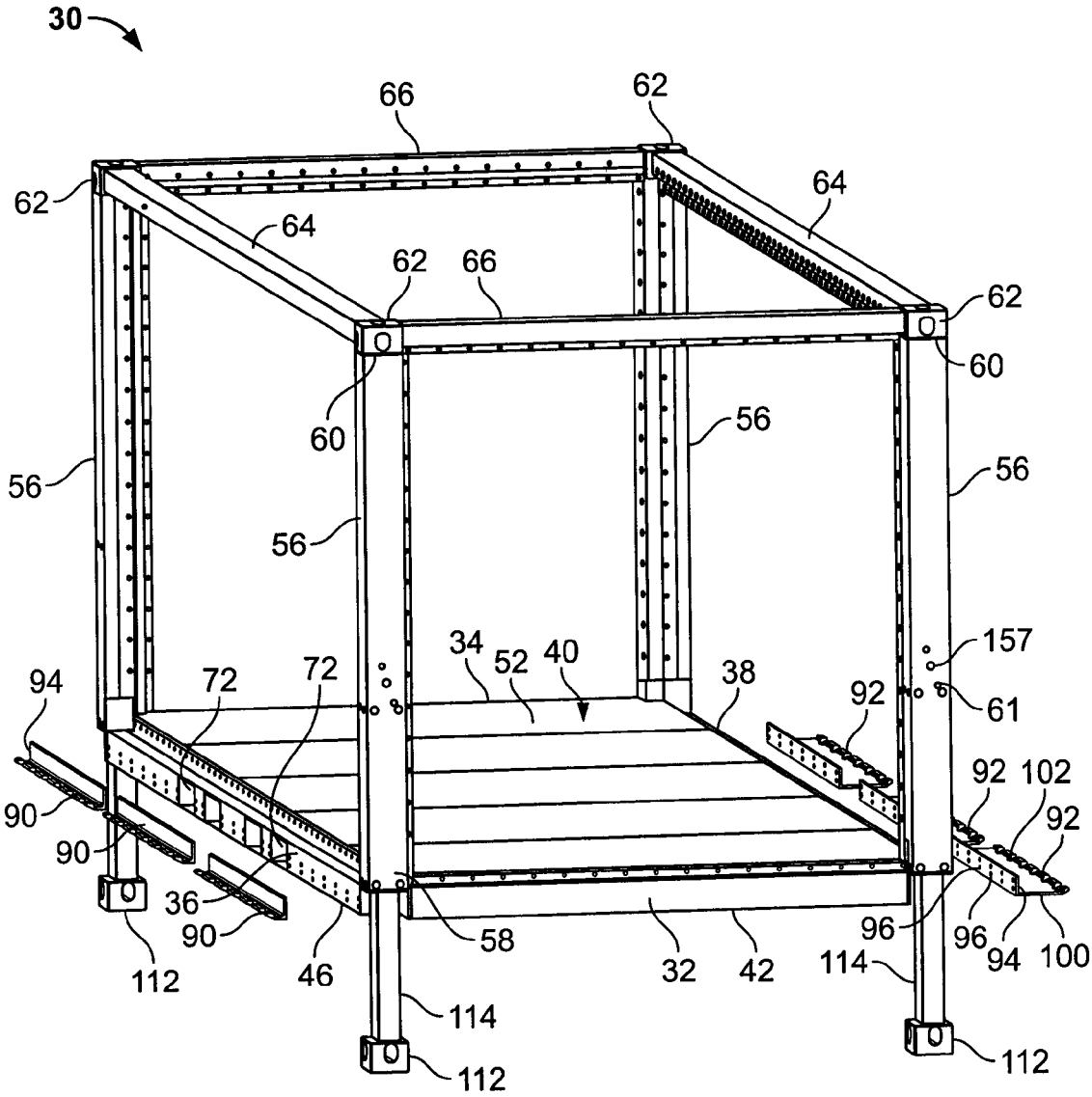
FIG. 2 is a perspective view of the ISO container of FIG. 1 shown with the side panels and top panels removed.
Figure 4:
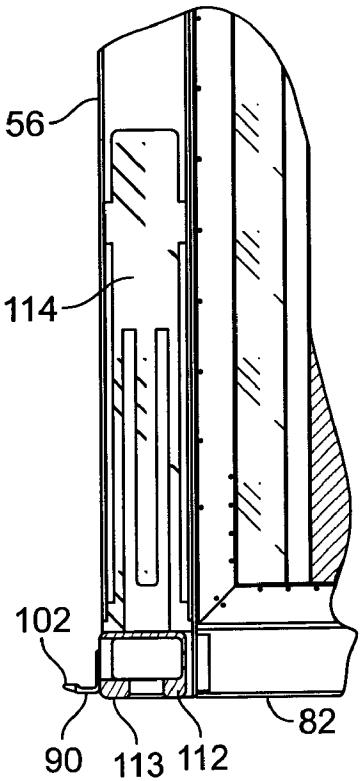
FIG. 4 is a partial cross sectional view taken along line 4-4 of FIG. 3.
Figure 3:
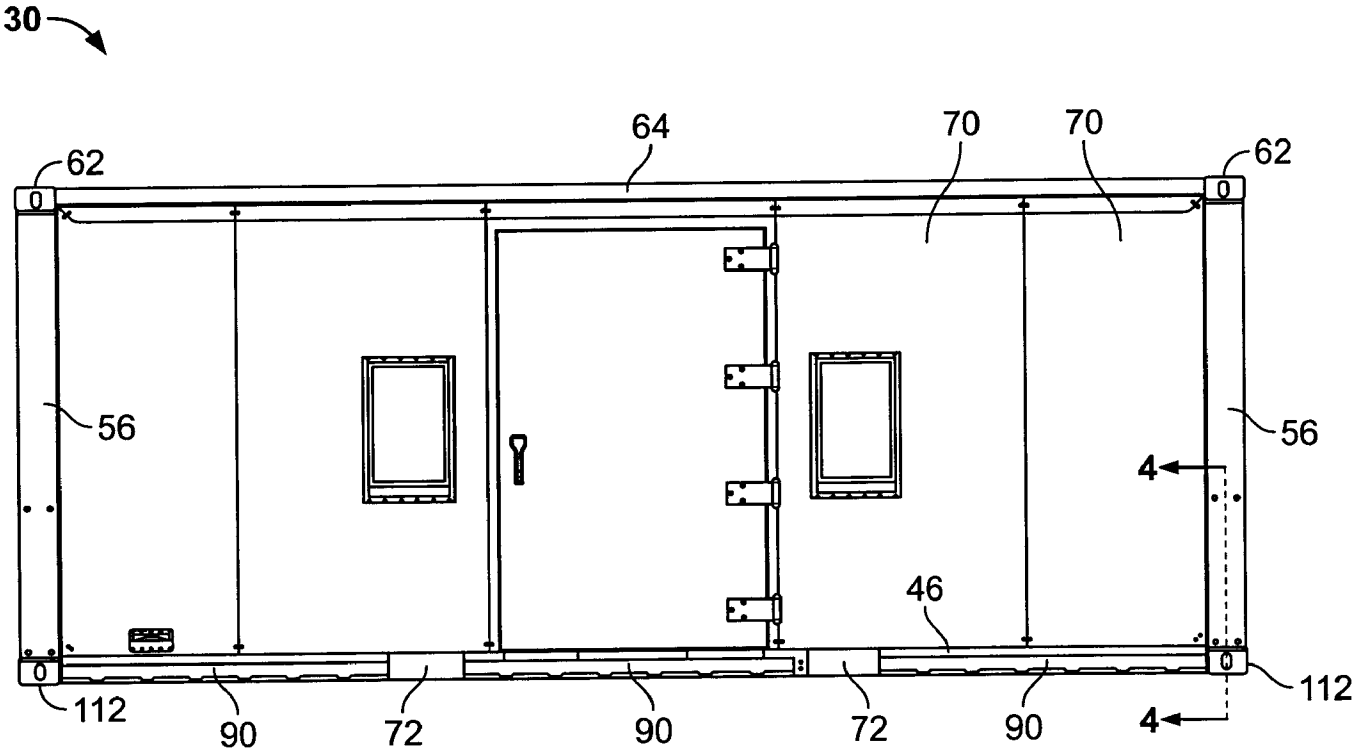
FIG. 3 is a side elevational view of the ISO container shown in an air transport position.
Figure 5:
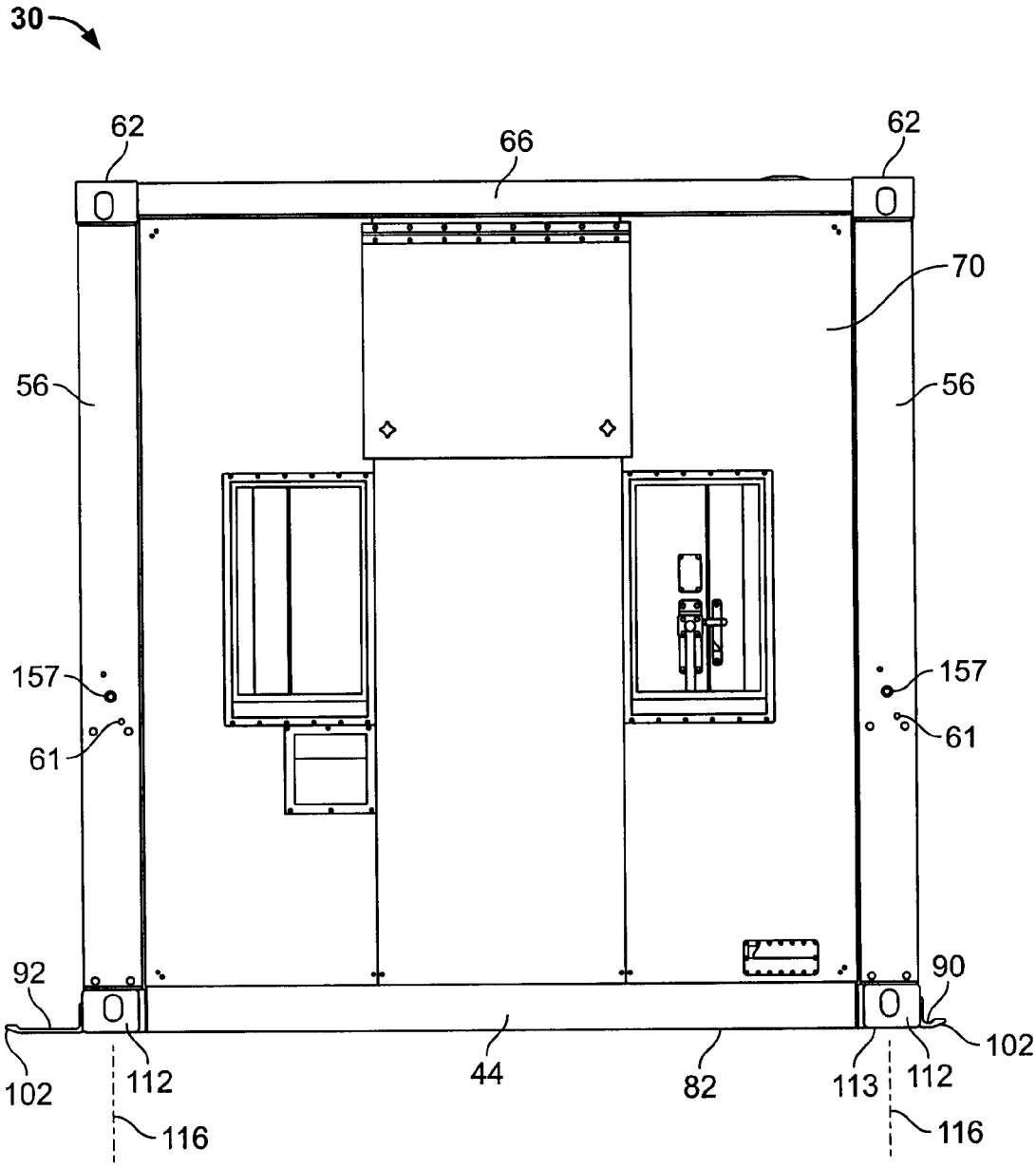
FIG. 5 is an end elevational view of the ISO container shown in the air transport position.
Figure 7:
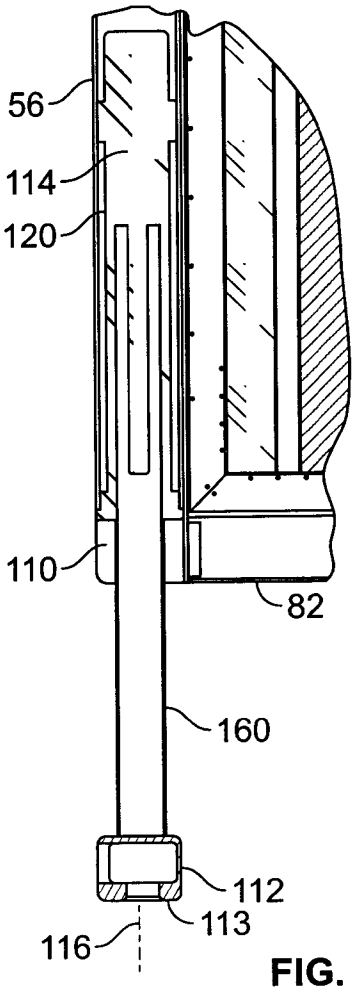
FIG. 7 is a partial cross sectional view taken along lines 7-7 of FIG. 6.
Figure 6:
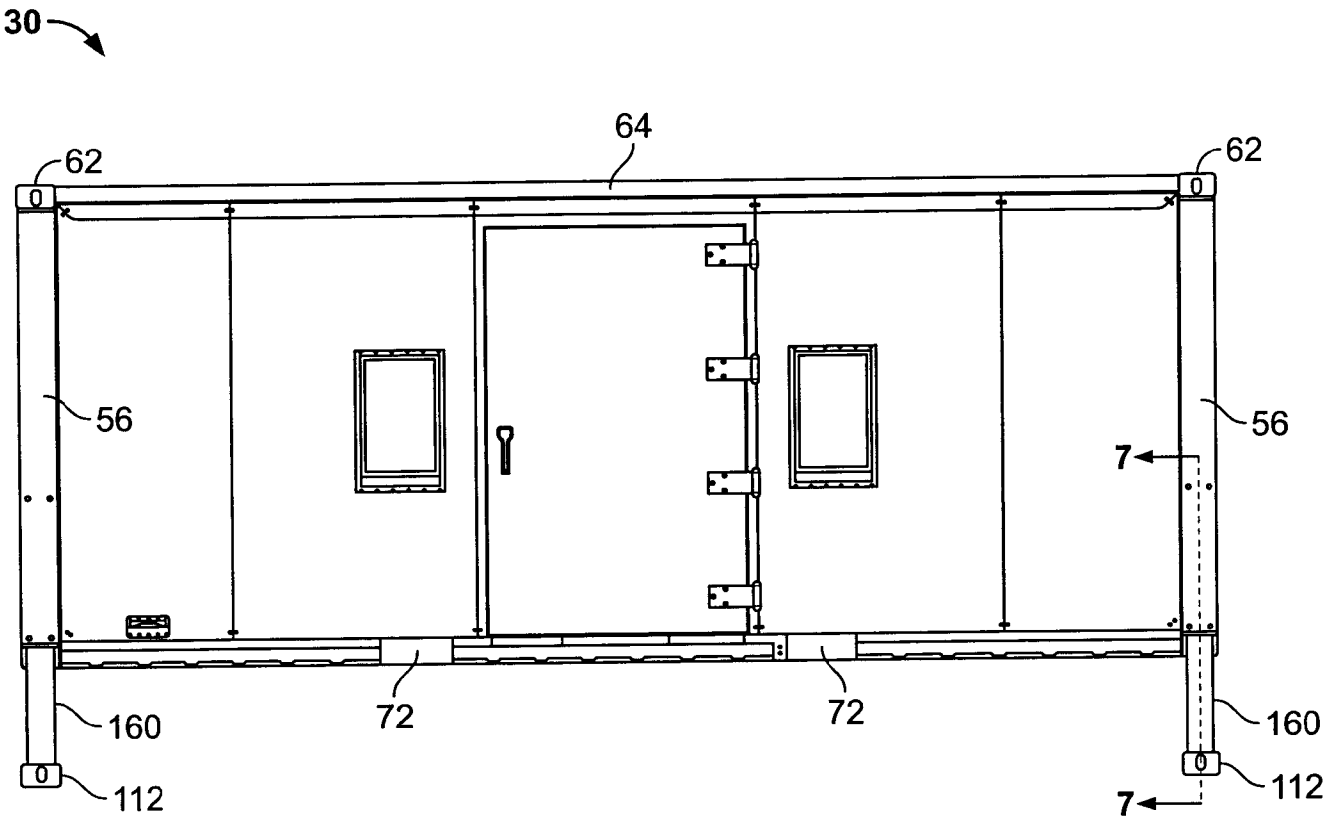
FIG. 6 is a side elevational view of the ISO container shown with the lower ISO corner blocks extended.
Figure 8:
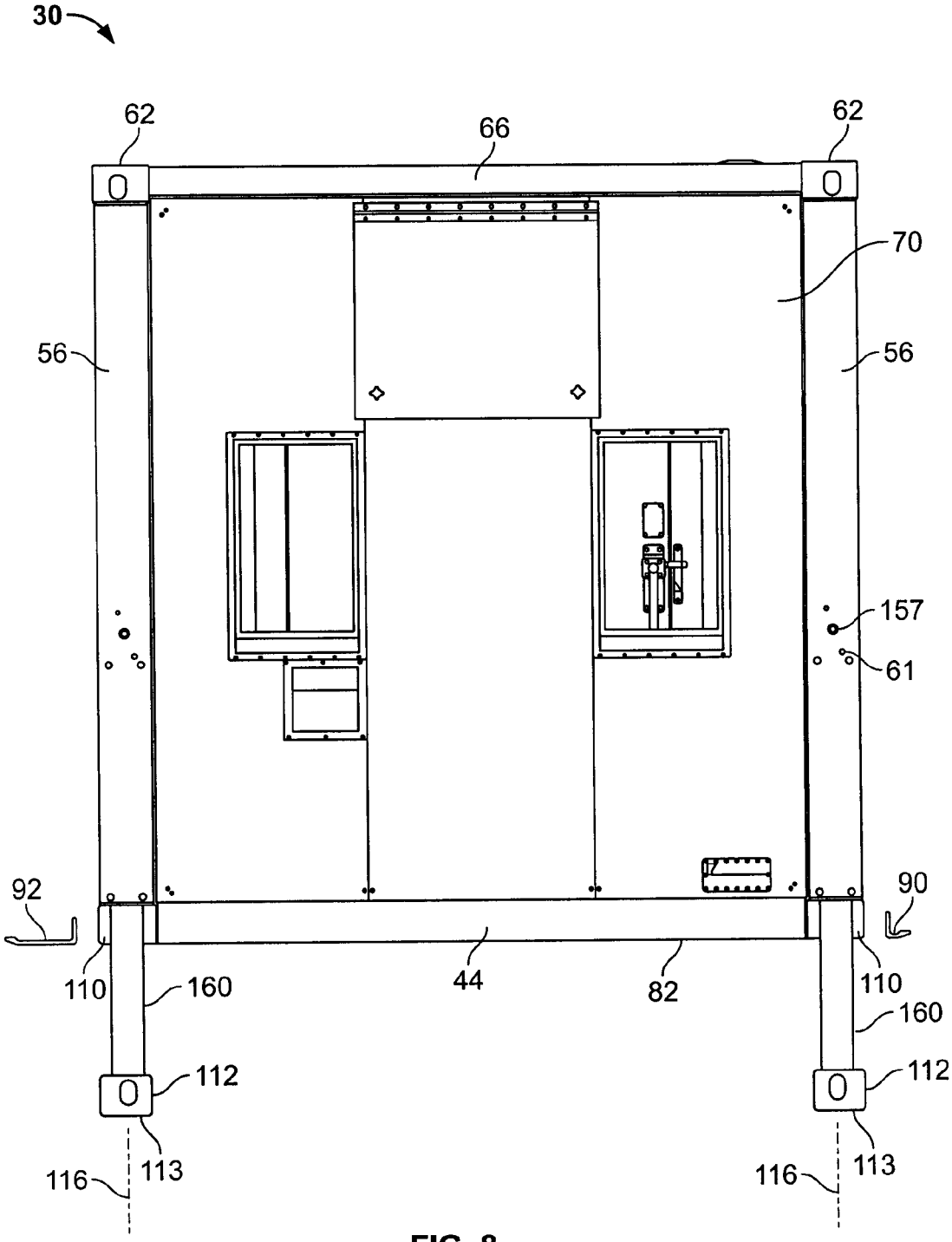
FIG. 8 is an end elevational view of the ISO container shown with the lower ISO corner blocks extended and the detent rails detached.

In operation, when it is desired to transport the ISO container 30 by aircraft, the drive member 152 is rotated by a ratchet or the like in the appropriate direction to rotate the shaft 138 about the axis 116 in the appropriate direction to fully retract the leg 160 and corner block 112 to a fully retracted air transport position as shown in FIGS. 3 through 5. In the air transport position the bottom surfaces 113 of the corner blocks 112 are located generally coplanar with, or are located vertically above, the bottom surface 82 of the roller plates 80A-D. The detent rails 90 and 92 are respectively attached to the side rails 46 and 48. The container 30 is then in an aircraft transport position or mode such that the container 30 may be loaded onto an aircraft by rolling engagement of the roller plates 80A-D with the rollers of an aircraft cargo handling system. The container 30 may be secured in place within the aircraft by engagement of the aircraft cargo handling system with the tabs 102 and detents 104 of the detent rails 90 and 92.

When it is desired to transport the ISO container 30 by truck, railcar or ship, the container 30 is converted to an ISO surface transport position or mode. The detent rails 90 and 92 are removed from the container 30. The drive member 152 is rotated by a ratchet or the like in the appropriate direction to appropriately rotate the shaft 138 about the axis 116 and thereby move the leg 160 and corner block 112 along the translational axis 116 from the fully retracted air transport position as shown in FIGS. 3-5 to the ISO surface transport position as shown in FIGS. 17 and 18 wherein the bottom surface 113 of the corner block 112 is located approximately one-half inch below the bottom surface 82 of the roller plates 80A-D. As the leg 160 is moved into the ISO surface transport position, the locking pins 174 of the connector member 166 align with the apertures 127 in the tubular member 122 of the housing 120 and with the bores 133 in the spacer collar 132. The biased locking pins 174 automatically move from their retracted positions to their extended positions wherein the second ends 178 of the locking pins 174 are located within respective apertures 127 and bores 133 to prevent movement of the leg 160 and corner block 112 along the axis 116 with respect to the corner post 56. Each corner block 112 is respectively moved to the ISO surface transport position. The container 30 is then in compliance with ISO requirements for an ISO container that is to be shipped by truck, railcar or ship.

When it is desired to place the container 30 in position for use or storage, the locking pins 174 are moved to the retracted position by inserting a tool through the aperture 61 in the corner post 56 and manually moving the locking pins 174 to their retracted positions. The drive member 152 is then rotated in the appropriate direction by a ratchet or the like to move the leg 160 and corner block 112 along the translational axis 116 to a position at a desired distance from the corner post 56, and from the air transport position and ISO surface transport position. Each corner block 112 may be individually moved and positioned along its respective axis 116 to place the base 40 of the ISO container 30 in a level horizontal position, or in such other orientation as may be desired. Each corner block 112 is selectively movable along its translational axis 116 from the fully retracted ISO surface transport position to a fully extended position. The corner blocks 112 may be movable along the axis 116 a distance of approximately twenty-four inches.

The ISO container 30 may be used to transport various types of goods, supplies and material, and may also be used for providing shelter for working and living space. The gearing between the pinion gear 154 of the drive member 152 and the beveled gear 150 of the shaft 138 enables the spacing of the corner blocks 112 from the corner posts 56 to be adjusted while the container 30 is located on a support surface and while the corner blocks 112 are supporting the load of the container 30.

A modified embodiment of the jack is shown in FIGS. 21-24 and is identified with the reference number 190. The jack 190 includes many of the same components as the jack 114 and like components are numbered with the same reference number. The jack 190 includes a powered actuator such as an electric motor 192. The motor 192 includes a rotatable output shaft that is operatively coupled to a gear box 194 including one or more gears. The housing of the motor 192 is attached to the housing of the gear box 194. A housing 196 attaches the housing of the gear box 194 to the second 126 of the outer tube 122. The housing 196 includes a coupler 194 that operatively couples an output shaft of the gear box 194 to the second end 142 of the shaft 138. The gear box 194 is adapted to reduce the revolutions per minute of the motor 192.

The motor 192 is reversible such that the output shaft of the motor 192 can be selectively rotated in either a clockwise direction or a counter-clockwise direction. Rotation of the motor 192 and its output shaft in a clockwise direction rotates the coupler 198 and the shaft 138 in a clockwise direction. Similarly, rotation of the motor 192 and its output shaft in a counter-clockwise direction is operative to rotate the shaft 138 in the counter-clockwise direction.

An electrical communication terminal block 200 is attached to the distal end of the motor 192. The terminal block 200 is in electrical communication with the motor 192. A manual controller is adapted to be placed in electrical communication with the terminal block and the motor 192 to provide selective operation of the motor 192 and thereby position the corner block 112 in a selected position with respect to the outer tube 122 along the translational axis 116.

The jack 190 may include a first limit switch 206 and a second limit switch 208. The limit switches 206 and 208 are attached to the outer tube 122 and are in electrical communication with the terminal block 200. The first limit switch 206 is located adjacent the first end 140 of the shaft 138 and the second limit switch 208 is located adjacent the second end 142 of the shaft 138 and adjacent the second end 126 of the outer tube 122. The first limit switch 206 is adapted to sense, through a first aperture in the outer tube 122, when the leg 160 and corner block 112 are located in a selected extended position, such that the first limit switch 206 will deactivate the motor 192 and will prevent the motor 192 from further extending the leg 160 and corner block 112. The second limit switch 208 is adapted to sense, through a second aperture in the outer tube 122, the position of the leg 160 and corner block 112 when they are located in a selected retracted position and to deactivate the motor 192 such that the motor 192 will not attempt to further retract the leg 160 and corner block 112.

The motor 192, gear box 194, coupler 198 and terminal block 200, as well as the limit switches 206 and 208, are all adapted to be located within a corner post 56 of the ISO Container 30. The leg 160 and corner block 112 of the jack 190 may also be manually extended and retracted by use of the drive member 152.

The transport device may be an airlift pallet such as disclosed in U.S. Pat. No. 6,622,640, or other types of devices for transporting cargo, rather than a container, which includes the roller plates 80A-D, detent rails 90 and 92, ISO corner blocks 112 and adjustment mechanisms 114.

Various features of the invention have been particularly shown and described in connection with the illustrated embodiments of the invention, however, it must be understood that these particular arrangements merely illustrate, and that the invention is to be given its fullest interpretation within the terms of the appended claims.

What is claimed is:

1. A transport device adapted to be transported by air or surface transportation, said transport device comprising:

a base;

a movable corner block movably coupled to said base; and an adjustment mechanism adapted to selectively position said corner block with respect to said base, said adjustment mechanism adapted to selectively move said corner block between an air transport position and a surface transport position, said adjustment mechanism including a leg having a first end coupled to the corner block and a second end coupled to a selectively rotatable shaft such that rotation of said shaft moves said corner block along a translational axis to a selected position with respect to said base, and a connector member coupled to said leg for conjoint movement with said leg and said corner block along said translational axis, said connector member including a rotatable ring and one or more locking pins coupled to said ring such that rotation of said ring conjointly moves each said locking pin between a retracted position and an extended position, said locking pins adapted to prevent movement of said leg and said corner block along said translational axis when said locking pins are in the extended position, said locking pins allowing movement of said leg and said corner block along said translational axis when said locking pins are in said retracted position.

2. The transport device of claim 1 wherein said base includes a first end and a second end, a first side rail and a spaced apart second side rail extending from said first end to said second end of said base, and one or more roller plates extending from said first end to said second end of said base, said roller plates located between said first side rail and said second side rail, each said roller plate including a generally planar bottom surface adapted to engage rollers of an aircraft cargo handling system.

3. The transport device of claim 1 wherein said base includes a first side rail and a spaced apart second side rail, a first detent rail attached to said first side rail, said first detent rail including a first leg having a plurality of tabs and detents, and a second detent rail attached to said second side rail, said second detent rail including a second leg having a plurality of tabs and detents, said tabs and detents adapted to cooperate with an aircraft cargo handling system to releasably secure said transport device in place within an aircraft.

4. The transport device of claim 3 wherein said first detent rail is adapted to be removably attached to said first side rail, and said second detent rail is adapted to be removably attached to said second side rail.

5. The transport device of claim 3 wherein said first detent rail includes a third leg located generally perpendicular to said first leg, said third leg adapted to be removably attached to said first side rail.

6. The transport device of claim 1 including a plurality of corner posts, each said corner post including a first end and a second end, said first ends of said corner posts being attached to said base, a plurality of said movable corner blocks, each said movable corner block being located adjacent said first end of a respective corner post, a plurality of said adjustment mechanisms, each said adjustment mechanism adapted to selectively position a respective movable corner block between an air transport position and a surface transport position, and a plurality of stationary corner blocks, each said stationary corner block being attached to said second end of a respective corner post.

7. The transport device of claim 6 wherein each said movable corner block and each said stationary corner block includes a first side wall including a first aperture and a second side wall including a second aperture.

8. The transport device of claim 6 including side walls extending between said corner posts and a roof such that said transport device comprises a container.

9. The transport device of claim 6 wherein said adjustment mechanisms are adapted to respectively move their associated movable corner blocks to a selected extended position which is located further from said air transport position than said surface transport position is located from said air transport position, whereby said adjustment mechanisms are adapted to respectively position said movable corner blocks with respect to said base such that said base may be supported by said movable corner blocks in a substantially level position.

10. The transport device of claim 1 wherein said base forms a pocket, and wherein said movable corner block is located substantially completely within said pocket when said movable corner block is located in said air transport position, said movable corner block being located at least partially outside of said pocket when said movable corner block is in said surface transport position.

11. The transport device of claim 1 wherein said shaft of said adjustment mechanism includes a first end, a second end and a central axis, said movable corner block being coupled to said shaft, and said adjustment mechanism includes an actuator for selectively rotating said shaft, whereby selective rotation of said shaft moves said movable corner block along said translational axis to a selected position with respect to said base.

12. The transport device of claim 11 wherein said actuator comprises a motor operatively coupled to said shaft, said motor adapted to provide selective rotation of said shaft about said central axis of said shaft.

13. The transport device of claim 11 wherein said adjustment mechanism includes a housing having a first end and a second end, said first end of said housing being attached to said base, said second end of said shaft and said second end of said leg being located within said housing, said second end of said shaft being rotationally coupled to said housing.

14. The transport device of claim 13 including a corner post attached to said base, said housing being attached to said corner post, said corner post and said base forming a pocket adapted to receive said movable corner block when said movable corner block is located in said air transport position.

15. The transport device of claim 14 wherein said actuator includes a drive member in operative engagement with said shaft, whereby rotation of said drive member provides rotation of said shaft about said central axis of said shaft.

16. The transport device of claim 15 wherein said corner post is generally tubular and said housing and said actuator are located within said corner post, said corner post including an aperture providing communication with said drive member of said actuator.

17. The transport device of claim 13 wherein said connector member is threadably attached to said shaft such that rotation of said shaft moves said connector member, said leg and said corner block along said translational axis, said locking pins of said connector member adapted to engage said housing in said extended position and thereby prevent movement of said leg and said corner block along said translational axis.

18. The transport device of claim 14 wherein said corner post includes an aperture that provides access to a locking pin such that said locking pin may be manually moved to said retracted position from said extended position by inserting a tool through said aperture to engage and manually move said locking pin.

19. The transport device of claim 1 wherein said shaft of said adjustment mechanism is threaded and said leg is threadably attached to said shaft, said shaft being selectively rotatable about said central axis of said shaft to provide movement of said leg and said corner block along said translational axis.

20. The transport device of claim 1 wherein said connector member includes a biasing member adapted to bias said locking pins toward said extended position.

* * * * *